United States Patent [19]

Furgang

[11] Patent Number: 4,723,499

[45] Date of Patent: Feb. 9, 1988

[54] FURLING SYSTEM FOR SAILBOATS

[76] Inventor: Bernard Furgang, 2766 Lemon Dr., Simi Valley, Calif. 93063

[21] Appl. No.: 766,650

[22] Filed: Aug. 19, 1985

[51] Int. Cl.[4] ..... B63H 9/10

[52] U.S. Cl. ..... 114/106; 114/104

[58] Field of Search ..... 114/39.1, 102, 103, 114/104, 105, 106, 107; 384/507, 508; 403/350–352, 355–387, 372

[56] References Cited

U.S. PATENT DOCUMENTS

| | | | |
|---|---|---|---|
| 3,608,511 | 9/1971 | Katshen, Sr. | 114/106 |
| 3,611,969 | 10/1971 | Hood | 114/106 |
| 3,658,025 | 4/1972 | Hood | 114/102 |
| 3,835,804 | 9/1974 | Jackson | 114/90 |
| 3,851,609 | 12/1974 | Stearn | 114/105 |
| 3,851,610 | 12/1974 | Stearn | 114/105 |
| 3,948,200 | 4/1976 | Hood | 114/105 |
| 4,030,439 | 6/1977 | Hood | 114/106 |
| 4,057,023 | 11/1977 | Hood | 114/107 |
| 4,059,063 | 11/1977 | Hood | 114/106 |
| 4,149,482 | 4/1979 | Hoyt | 114/106 |
| 4,196,687 | 4/1980 | Newick | 114/106 |
| 4,248,281 | 2/1981 | Hood | 114/106 |
| 4,267,791 | 5/1981 | Ingouf | 114/106 |
| 4,324,192 | 4/1982 | Ingouf | 114/106 |
| 4,376,417 | 3/1983 | Blonski | 114/106 |
| 4,449,468 | 5/1984 | Schultz | 114/104 |
| 4,573,424 | 3/1986 | Clausin | 114/106 |

FOREIGN PATENT DOCUMENTS

| | | | |
|---|---|---|---|
| 197861 | 5/1923 | United Kingdom | 384/508 |
| 0641194 | 1/1979 | U.S.S.R. | 403/352 |

OTHER PUBLICATIONS

Practical Sailor, Nov. 1, 1983, vol. 9, No. 21.

A Comprehensive Report: Furling Systems, date unknown, Brian Bowdren, Editor, pp. 1–20.

Viscom International, Inc., catalog title, The Profurl, West Simsbury, Conn.

Viscom International, Inc. catalog, title Electric, W. Simsbury, Conn.

Hyde Products, Inc., catalog title, Stream Stay, Cleveland, Ohio.

Mariner catalog title, Roller Furling Systems, Santa Monica, Calif.

North Atlantic Marine Supply catalog title, Tube Furl, Cheshire, Conn.

FaMet Marine catalog, title Reefurl, Redwood City, Calif.

Harken catalog, title Harken Jib Reefing & Furling Systems

Sparcraft catalog, title Twin Stay/Dyna Furl Specifications, Irvine, Calif.

Stream-Stay Inc. catalog, title Stream Stay 2, Cleveland, Ohio.

Hood advertisement, title Sea Furl, Marblehead, Mass.

Stream Stay Yacht Products advertisement, Westlake, Ohio, Sail magazine, Sep., 1983.

Harken advertisement, Pewaukee, Wisc.

Crusing Design, Inc. catalog. 1984, Peabody, Mass.

*Primary Examiner*—Joseph F. Peters, Jr.

*Assistant Examiner*—Edwin L. Swinehart

*Attorney, Agent, or Firm*—John E. Wagner

[57] ABSTRACT

A roller reefing system for use on the existing forestay of a sailboat such that it surrounds the forestay when installed and in use. The system includes a furling member which is composed of a plurality of indentical cross section members, each of which has a longitudinal opening to receive the forestay, and a connecting sleeve for connecting adjacent members together and for locating a bearing element within the longitudinal opening. The roller reefing system may be easily installed on the existing forestay of a sailboat without modification to the forestay.

7 Claims, 12 Drawing Figures

12A
12
15
31
25
12
20U
24
g
12
15
31
32
35
25
34
33
33A
24f
24e
24
24d
30
14
24c
30
24b
24
24a
22
23
21
11
10
20L
13
16
23
46
24
42
40
45
43
15
41
44
21

FURLING SYSTEM FOR SAILBOATS

BACKROUND OF THE INVENTION

Over the years the need has been recognized for effective furling and reefing systems for sailboats. A number of systems have been developed which may be installed in place of the forestay of the sailboat, and include a roller mechanism for rotating an elongated headfoil to roll a jib or other foresail about its luff or leading edge to reduce or increase the foresail area. These are usually termed roller reefing systems.

Typically the substitute forestay member is an aluminum extrusion or cable having a swivel connection at the top for rotatable connection to the mast, and a drum or spool at the lower end adapted to receive a furling line which is used to rotate the furling system.

The jib or other foresail usually includes a conventional rope luff which slides in a C shaped opening in one edge of the headfoil.

Examples of roller reefing systems are disclosed in the following U.S. Pat. Nos.:

| Patent No | Date | Inventor |
|---|---|---|
| 4,248,281 | Feb. 3, 1981 | F. E. Hood |
| 4,196,687 | Apr. 8, 1980 | R. C. Newick |
| 4,376,417 | Mar. 15, 1983 | P. Blonski |
| *4,059,063 | Nov. 22, 1977 | F. E. Hood |
| *4,449,468 | May 22, 1984 | W. A. Schultz |
| *4,324,192 | Apr. 13, 1982 | P. Ingouf |
| *4,057,023 | Nov. 8, 1977 | F. E. Hood |
| *4,030,439 | Jun. 21, 1977 | F. E. Hood |
| 3,608,511 | Sept. 28, 1971 | B. R. Katshen Sr. |
| 3,835,804 | Sept. 17, 1974 | P. T. Jackson |

*Disclose mainsail roller furling systems.

Rope luff jib sails are illustrated in:

| | | | |
|---|---|---|---|
| 3,948,200 | | Apr. 6, 1976 | F. E. Hood |
| 4,324,192 | supra | | |
| 3,835,804 | supra | | |

Examples of commercial systems are described in catalogs and brochures, copies of which accompany this application as part of the prior art statement.

BRIEF DESCRIPTION OF THE INVENTION

I have been sailing for many years and am familiar with most of the available furling and reefing systems. I've found, however, that these systems are expensive, require replacement or expensive modification of the forestay for installation, commonly require a whole new set of sails to be used on the system. They often encounter jamming when in use, particularly, the rope luff in the track of the system.

It appeared to me there must be a better way to develop a roller reefing system, which can be installed by the sailor himself easily, without total dismantling or replacement of the forestay, which allows the use of his present sails, and one which is more effective in operation.

I developed such a system which is constructed of a number of headfoil sections, each of which are secured end for end to produce the required length of headfoil member. This headfoil member includes an aperture extending from top to bottom which receives the existing forestay on the sailboat without modification. The tuning of the mast assembly with its existing stays is not modified or affected. The headfoil is genuine airfoil in shape and includes a modified C shape longitudinal groove at its trailing edge which receives a number of slides. These slides are securable to the existing sails usually without any other modification. These slides of a low friction surface allow the sailor to attach any headsail, for example, a working jib, a Genoa, a drifter, a reacher, or other headsail to the foil with ease. The headfoil is secured to the forestay on low friction bearings at four foot intervals and one at the extrusion head. The bearings, located at maximum of four foot spaced locations, ride on the forestay to distribute the load on the forestay and to provide smooth rotation of the headfoil and rapid and reliable reefing. The lowermost bearing is contained within the drum to complete the low friction system. The drum is covered with a shield tensioner which prevents overides when reefing or furling. The result of the above combination is that the boat owner may in few hours install his own roller reefing system, install his existing sails and get underway without any interference and modification of his existing forestay or sails. This is accomplished using only common handtools such as a screw driver, wrench and a sailmaker's kit for securing the slide to the existing sails. When underway, he has complete freedom from the cockpit to roller reef the headsail to the precise amount desired.

The headfoil is of true airfoil shape providing efficient airflow over the headsail and providing the stiffness of the headfoil plus its own stiffness to achieve an efficient and predictable headsail system.

BRIEF DESCRIPTION OF THE DRAWING

These and other features of this invention may be more clearly understood from the following detailed description and by reference to the drawing in which.

DETAILED DESCRIPTION OF THE INVENTION

Figures 1, 2, 3:
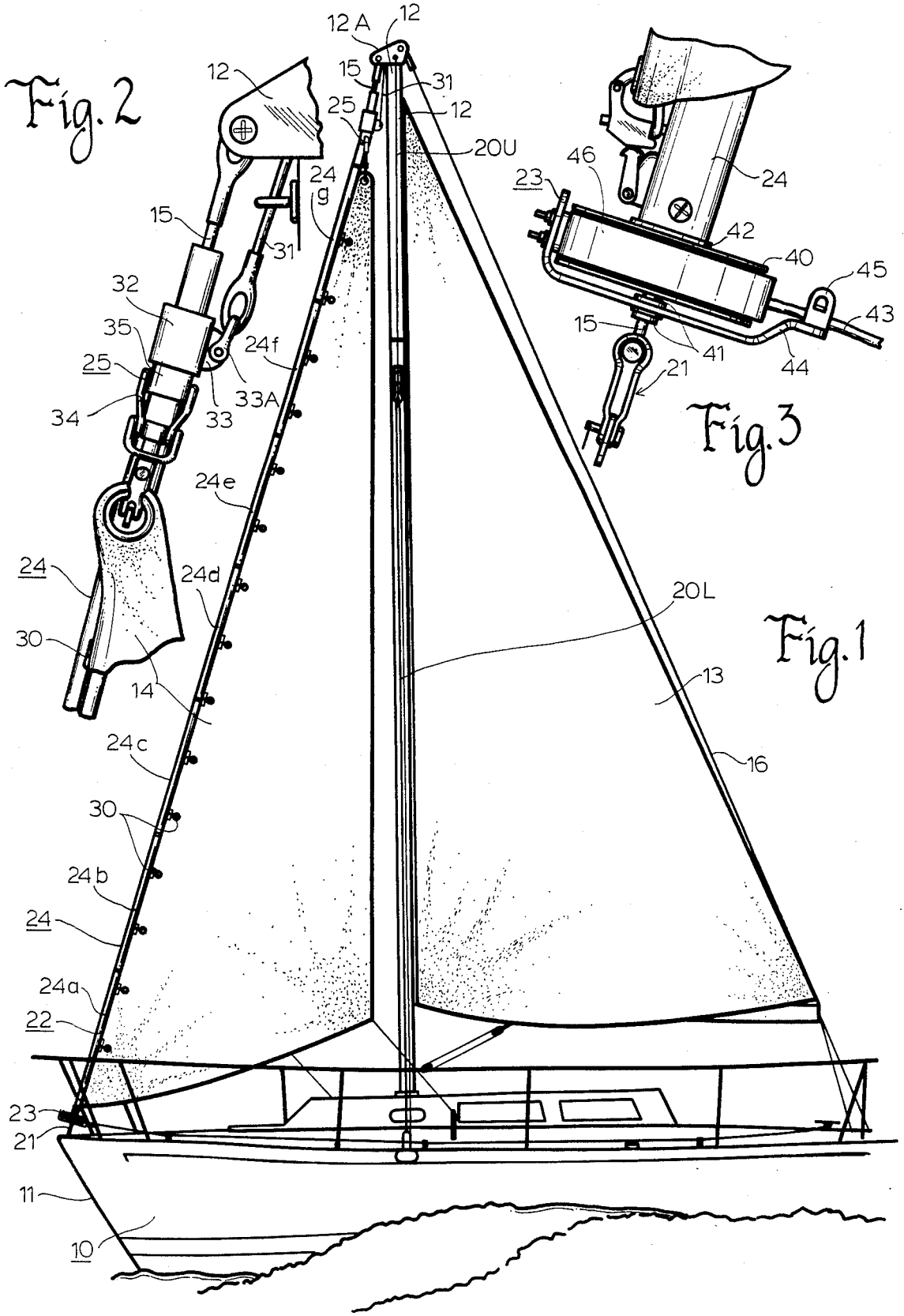
FIG. 1 is a side elevational view of a cruising sailboat employing the system of my invention.
FIG. 2 is a fragmentary enlarged detail of the halyard swivel and yoke portions thereof.
FIG. 3 is an enlarged fragmentary side elevational view of the furling spool of this invention.

The application of this invention is best illustrated by FIG. 1 which should be reviewed in connection with FIGS. 2 and 3. FIG. 1 shows a modern cruising sailboat of the type for which this invention is particularly useful. The sailboat, generally designated 10, includes a hull 11, a mast 12, a mailsail 13 and a foresail 14, commonly a jib, which are individually raised on halyards from a lower or stowed position. A forestay 15 and a backstay 16 as well as port and starboard shrouds, and the port upper and lower shrouds 20U and L which appear in FIG. 1, hold the mast in a vertical or raked position. The stays 15 and 16 and port and starboard shrouds 20U and 20L are usually stainless steel stranded cables with eyes and turnbuckles for adjusting their tension to position the mast and to tune the mast system.

In this case, the forestay 15 is the standard forestay of the sailboat 10 but note that enclosing the forestay 15 from near the masthead 12A to its clevis 21 (FIG. 3) is a reefing-furling assembly generally designated 22 comprising a roller drum assembly 23 at the base, an airfoil shaped roller reefing member 24 made up of a plurality of sections 24A–H and a halyard swivel assembly 25 at the top thereof.

The foresail 14, in this case a jib, is of conventional design and is secured to the reefing member 24 at a plurality of points on its luff by slides 30 shown as extending partially out of the reefing member 24 but better seen in FIGS. 5 and 7–10. The top of the jib 14 is secured to the jib halyard 31 via the halyard swivel assembly 25 of FIG. 2.

Figure 11:
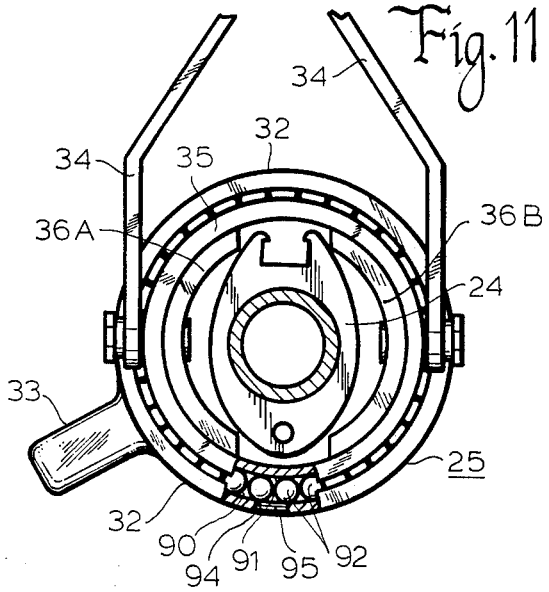
FIG. 11 is a fragmentary top plan of the halyard swivel and yoke assembly of this invention.

The halyard assembly 25 of this invention includes a body 32, and yoke 34 which overlies the reefing member 24 in slidable relationship and includes a tang 33 with a shackle 33A designed to receive the end of the jib halyard 31 which in turn passes through a halyard pulley, unshown but located in the masthead 12A. This halyard assembly 25 allows the foresail 14 to be raised and lowered in the conventional manner. As seen in FIG. 11, the assembly 25 includes the body 32, a tang 33 for receiving a shackle and jib halyard 31 of FIG. 2, and a yoke 34 pivotally connected to an internal sleeve 35 which is rotatably mounted by ball bearings within the body 32 and sleeve 35. The sleeve 35 includes a pair of low friction segments 36A and 36B. These segments contact the heat foil 24 at four points thereby positioning the head foil for easy and rapid raising and lowering of the jib or other head sail.

Figure 6:
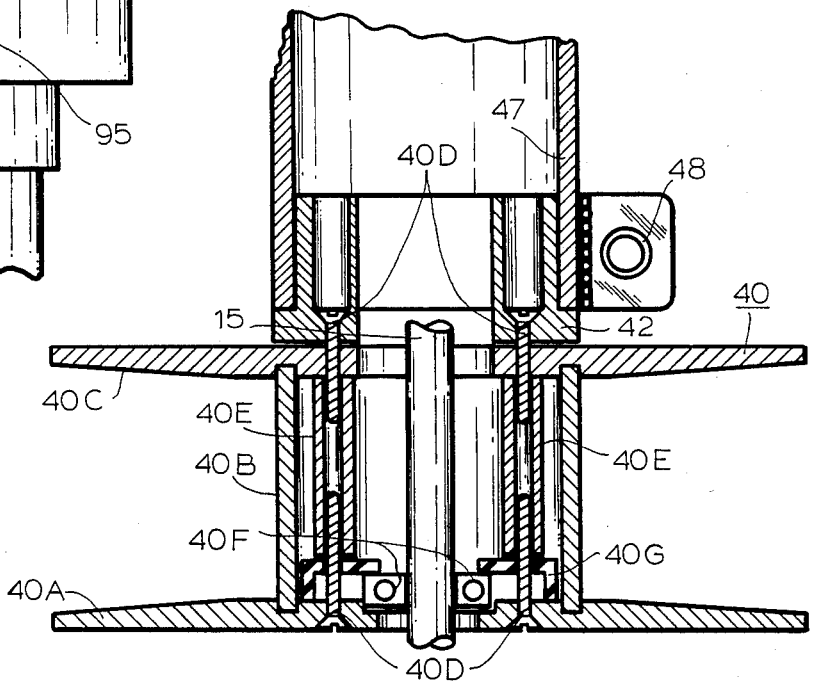
FIG. 6 is a vertical sectional view of the furling spool or drum of FIG. 3.
Figure 7:
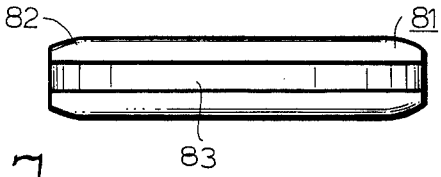
FIG. 7 is a top plan view of a slide used in this invention.
Figure 9:
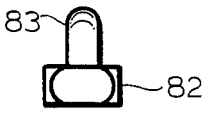
FIG. 9 is an end view thereof.
Figure 8:
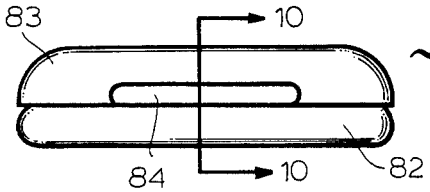
FIG. 8 is a side elevational view thereof.
Figure 10:
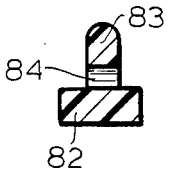
FIG. 10 is a sectional view of the slide of FIGS. 7–9 taken along lines 10—10 of FIG. 8.
Figure 4:
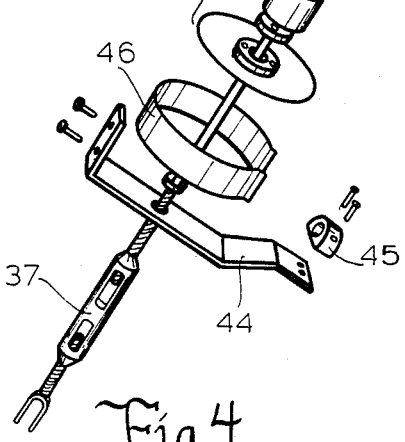
FIG. 4 is an exploded view of this invention.

Referring now particularly to FIGS. 3, 4 and 6, the roller drum assembly 23 may be seen as comprising a drum 40, rotatably mounted on internal bearings 40F, of FIG. 6, which encircle the forestay 15, and with the outer bearing race are secured to the body of the drum assembly 23 of FIGS. 1 and 3. The drum 40 is secured to the reefing member 24 by a spool hub extension 42, best seen in FIG. 4, to cause its rotation in either direction depending upon the direction of coil applied to a reefing line secured at one end to the drum 40 and encircling the drum, and exiting the drum via bracket 44 and fairlead 45. The free (bitter) end of reefing line is free and may be secured to a cleat. The drum assembly 23 includes a cover 46 of FIG. 3 which prevents overriding of the furling line and protection from spray.

Referring now specifically to FIG. 6, the spool or drum 40 may be seen as including a lower flange 40A, a hub 40B and an upper flange 40C, held together by four pair of screws 40D, two pair of which appear in FIG. 6, and drawing the flanges and hub together by being threaded in sleeves 40E. The ball bearing assembly 40F is seated in an annular groove in the lower flange 40A and held in place by a bearing cover 40G which in turn is positioned and secured by screws 40D and sleeves 40E. The bearing assembly 40F is sealed within the spool 40 by the bearing cover 40G and transfers load from the drum 40 to the forestay 15 just above the turnbuckle 37 of FIG. 4.

The spool 40 is secured at its upper flange 40C to spool hub extension 42 and to turnbuckle cover 47 including an eye 48 welded to the turnbuckle cover 47 for securing the bottom of the luff tack to the foresail 14.

Of most importance is the fact that the foresail 14 may be roller reefed by a single individual in the cockpit to reduce or increase the foresail area merely by letting out or taking in the reefing line 43 and equally tending the jib sheet. For a further understanding of this invention, reference is now made to FIG. 4 which is an exploded view of the reefing assembly 23 of FIG. 1.

Figure 5:
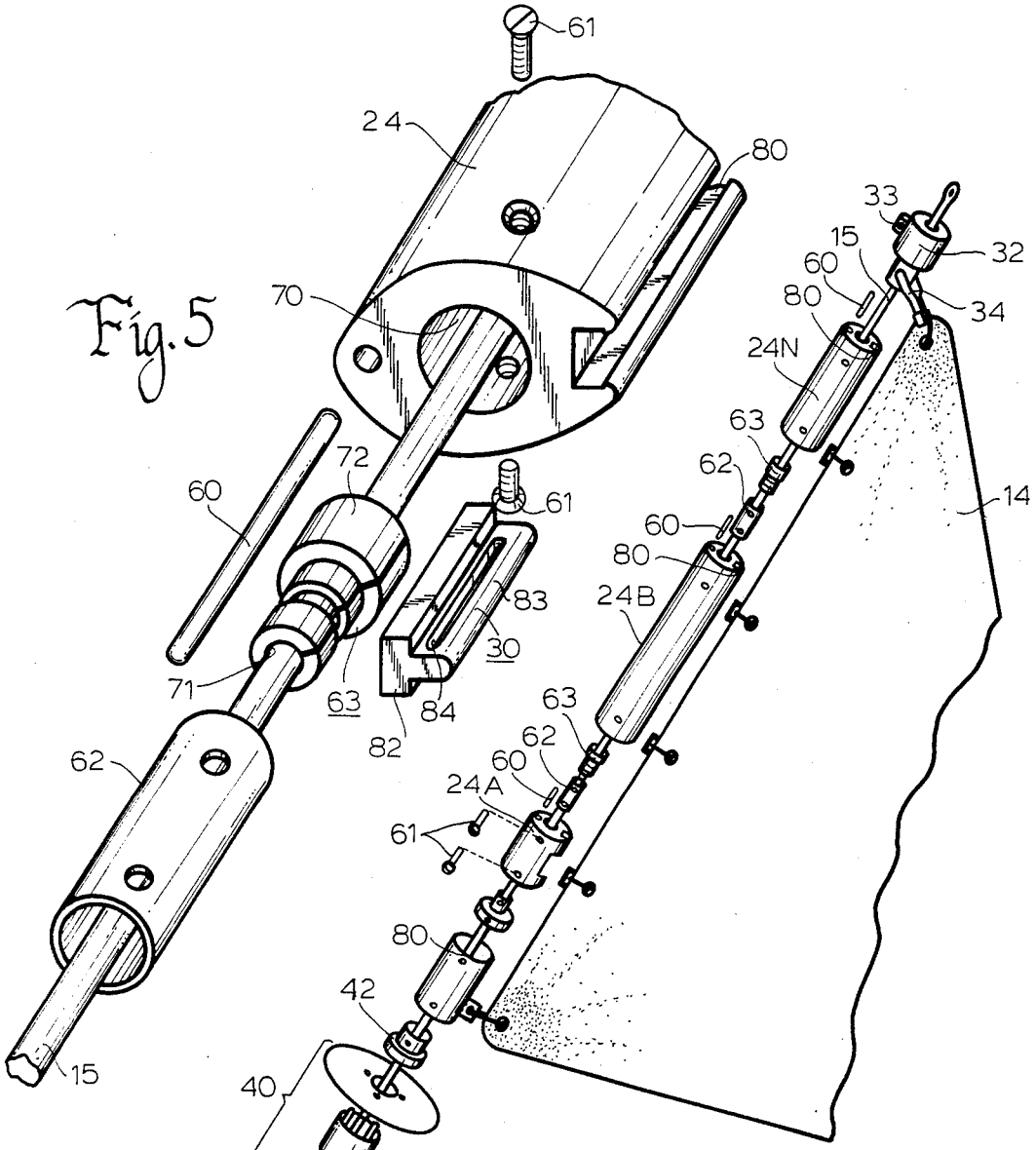
FIG. 5 is a fragmentary perspective view of a section and joint of the headfoil of this invention.

Referring to FIGS. 4 and 5, it may be seen that the reefing member 24 is in fact a series of identical cross-section members 24A–24N which are secured in for example, basic four foot (24B), and two foot (24N) to each other by alignment pins 60 and locking screws 61 engaging foil alignment sleeves 62. Each section includes a split bearing assembly 63 with an aperture therethrough in sliding fit with the forestay 15 to allow the reefing assembly 24 to rotate on bearings 63 about the forestay 15, to provide a precise rotational mechanism and to transfer the load of the foresail 14 to the forestay 15 at a number of points along the length of the furling member 24.

It is also apparent in FIGS. 4 and 5 that the furling member 24 not only maintains the straight line of the forestay by reason of the bearings 63 and its inherent strength, but is configured as a true airfoil to direct wind on both sides of the sail smoothly for minimum disturbance of the wind reaching the foresail 14. This is in direct contrast with prior art furling systems which often tend to be secured only at their upper and lower extremities and tend to bend, and often are not in a true airfoil shape since they must provide primary structural strength to act as a forestay, and secondarily act as a furling member. The furling member 24 is preferably extruded from 6061-T6 aluminum and triple anodized providing the required strength and corrosion resistant surface.

The structural strength of this system and the intermediate bearing load transfer is achieved incorporating the features best seen in FIG. 5. The structural member 24 has an airfoil shape and achieves a high strength to weight ratios since its bulk metal is located at the periphery and fore and aft to resist bowing. Inter-section strength is achieved by the alignment pin 60 and foil attachment sleeve 62 secured to each adjacent section 24 by locking screws 61. The low friction bearing 63 of a material such as Delrin, is held within the longitudinal bore 70 of section 24 by the sleeve 62. Bearings 63 each have a bore 71, sized to receive the forestay 15 in sliding fit. A circular boss 72 is dimensioned to engage in press fit relationship with the bore 70.

As is also apparent in FIG. 5, bearing 63 includes an annular groove spaced from the boss 72 a distance equal to the screw receiving openings of sleeve 62. Therefore, one of the screws 61 may extend through section 24, sleeve 62 and into the annular groove of the bearing 63 to secure it in place. Therefore each section provides a load transfer point through a low friction bearing assembly. In a five section headfoil system, at least seven bearings are present, one per section, one on the lower foil section 24A and one in the uppermost section 24N.

Another feature of this invention is apparent in FIGS. 4 and 5, namely the presence of a longitudinal groove 80 in the reefing members 24 which receives a series of slides 30 of low friction material such as 6061-T6 Alum-Teflon impregnated slides 30 as depicted in FIGS. 7–10 to which reference is now made. The slides 30 include an elongated base 82 having a width sufficient to be maintained within the restricted throat groove 80 in the reefing members 24 of FIG. 5. Extending out of the reefing member 24 is an upstanding portion 83 with an opening 84, appearing in FIGS. 8, 10, through which a nylon webbing is laced and sewn. The use of slides eliminates the perennial problem in roller reefing systems of a sail luff tape jamming in the groove, particularly in a reefing member which bows under load.

Referring again to FIGS. 11 and 12, an important feature of this invention may be seen. For truly effective operation, the airfoil shaped member 24 must be free to move angularly to the precise heading as defined by the tension on the jib sheet. The presence of the member 24 must not interfere with free movement in raising and lowering of the jib via the jib halyard. Therefore, the jib halyard assembly 25 must allow the headfoil 24 to rotate freely despite the extreme load of the foresail. Free movement in the halyard assembly is accomplished employing the novel thrust bearing assembly of FIG. 11.

The two sleeve-like members, body 32 and internal sleeve 35, each include mating annular grooves 90 and 91 which define a race for ball bearings 92. These ball bearings 92 are introduced into the race of grooves 90 and 91 by insertion in a hole 94, sealed by screw plug 95. One of the difficult problems in the bearing assembly, namely insertion of the balls, is simplified by this arrangement, which does not require any distortion of the bearing assembly race during ball insertion.

Figure 12:
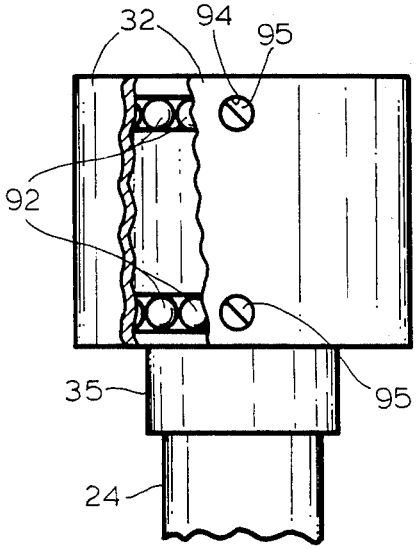
FIG. 12 is a fragmentary elevational view of the halyard assembly of this invention with portions broken away for clarity.

The large bearing surface available between body 32 and internal sleeve 35 is apparent in both FIGS. 11 and 12. The wall thickness of both of these parts defining the bearing race may have adequate thickness without limitation, due to assembly requirements. Effective thrust bearing loading may be accomplished with two, three or more races and sets of ball bearings. In FIG. 12, two races and sets of ball bearings are shown.

The above described embodiments of the present invention are merely descriptive of its principles and are not to be considered limiting. The scope of the present invention instead shall be determined from the scope of the following claims, including their equivalents.

What is claimed is:

1. In a roller reefing system for sailboats employing a forestay wherein the forestay of the sailboat may remain in place and wherein the roller reefing system surrounds the forestay when installed and in use, said improvement comprising:

the roller reefing system including a furling member comprising a plurality of substantially identical cross section members and of total length slightly less than the overall length of said forestay;

each of said plurality of substantially identical cross section members having a longitudinal opening therethrough to provide a continuous opening through said roller reefing system for receiving said forestay and for receiving support from said forestay when in use;

a union between each of said plurality of members, said union comprising:

a sleeve extending partially into the end of each adjoining member within the said continuous opening and surrounding the forestay;

bearing means at each of said unions;

said bearing means comprising a split cylindrically shaped low friction solid;

said bearing means having a central opening dimensioned to encircle the forestay in sliding engagement therewith;

the exterior of said bearing means having an external dimension corresponding to the internal dimension of said sleeve and in press fit therewith to retain said bearing in position;

wherein said bearing means includes an annular groove therein; and securing means accessible from the exterior of said adjacent members for securing said sleeve to both said adjacent members;

one of said securing means extending into the annular groove of said bearing means to additionally secure said bearing means from longitudinal movement within said roller reefing system; and means coupled to the lowermost of said members for rotating said roller reefing system.

2. In a roller reefing system for sailboats employing a forestay wherein the forestay of the sailboat may remain in place and wherein the roller reefing system surrounds the forestay when installed and in use, said improvement comprising:

the roller reefing system including a furling member comprising a plurality of substantially identical cross section members and of total length slightly less than the overall length of said forestay;

each of said plurality of substantially identical cross section members having a longitudinal opening therethrough to provide a continuous opening through said roller reefing system for receiving said forestay and for receiving support from said forestay when in use;

a union between each of said plurality of members, said union comprising:

a sleeve extending partially into the end of each adjoining member within the said continuous opening and surrounding the forestay;

bearing means at each of said unions;

said bearing means comprising a split cylindrically shaped low friction solid;

said bearing means having a central opening dimensioned to encircle the forestay in sliding engagement therewith;

the exterior of said bearing means having an external dimension corresponding to the internal dimension of said sleeve and in press fit therewith to retain said bearing in position;

wherein the ends of adjacent members include mating recesses thereon spaced from said opening therein;

including locking pin means extending into said mating recesses to provide torsional strength to said system.

3. The roller reefing system in accordance with claim 2 wherein said members are of air foil shape and said mating recesses are located at the foreward region of said airfoil shape in an area of substantial volume of material of said member for added torsional strength.

4. The roller reefing system in accordance with claim 2 wherein a portion of the outer surface of said bearing means is in bearing relationship with the internal surface defining said opening in one of said adjacent members.

5. The roller reefing system in accordance with claim 2 wherein said bearing means is stepped in outside diameter including a first section having an outside diameter corresponding to the inside diameter of the opening in said members and a second section having a outside diameter corresponding to the inside diameter of said sleeve.

6. The roller reefing system in accordance with claim 5 wherein said annular groove is located in said second section whereby securing means for said sleeve engages the annular groove in said second section.

7. The roller reefing system in accordance with claim 2 wherein said sleeve securing means comprises a pair of screws, each extending through end regions of adjacent members;

one of said screws being of sufficient length to extend into said annular groove and to secure said bearing means in place within said opening in said members.

* * * * *